United States Patent [19]

Puccio

[11] 4,148,167

[45] * Apr. 10, 1979

[54] CONCOURSE SEAL

[75] Inventor: Guy S. Puccio, Amherst, N.Y.

[73] Assignee: Acme Highway Products Corporation, Buffalo, N.Y.

[ * ] Notice: The portion of the term of this patent subsequent to Nov. 30, 1993, has been disclaimed.

[21] Appl. No.: 797,074

[22] Filed: May 16, 1977

[51] Int. Cl.[2] ..... E01C 11/04; E01C 11/02

[52] U.S. Cl. ..... 52/396; 52/573; 404/65; 404/69

[58] Field of Search ..... 52/396, 393, 403, 470, 52/471, 573; 404/64, 65, 69

[56] References Cited

U.S. PATENT DOCUMENTS

| | | | |
|---|---|---|---|
| 3,160,249 | 12/1964 | Pavdecka | 52/586 |
| 3,527,009 | 9/1970 | Nyquist | 52/396 X |
| 3,585,910 | 6/1971 | Brown et al. | 404/69 |
| 3,606,826 | 9/1971 | Bowman | 404/64 X |
| 3,626,822 | 12/1971 | Koster | 404/69 X |
| 3,742,911 | 7/1973 | Lehe et al. | 52/586 X |
| 3,765,784 | 10/1973 | Watson et al. | 404/64 |
| 3,788,758 | 1/1974 | Scheffel | 52/573 |
| 3,887,292 | 6/1975 | Koster | 52/396 X |
| 3,888,599 | 6/1975 | Reifsnyder | 52/396 X |
| 3,918,824 | 11/1975 | Bowman | 404/64 |
| 3,919,820 | 11/1975 | Green | 52/396 |
| 3,994,609 | 11/1976 | Puccio | 52/396 X |

FOREIGN PATENT DOCUMENTS

| | | | |
|---|---|---|---|
| 974110 | 9/1975 | Canada | 52/396 |
| 577543 | 5/1946 | United Kingdom | 52/586 |

*Primary Examiner*—Leslie Braun
*Attorney, Agent, or Firm*—Christel & Bean

[57] ABSTRACT

An expansion joint seal for use preferably in walkways and the like having a pair of elongated, parallel spaced-apart slab members defining a gap therebetween with each of the slab members having a generally C-shaped cavity opening toward said gap. The seal includes mounting beads on each of its longitudinal edges for assembly within the aforesaid slab cavities and an intermediate section spanning the aforesaid gap and being attached to the mounting beads. Each mounting bead is of tubular construction and includes an outer wall surface configuration generally adapted for matching engagement with said cavity. The radius of curvature of each mounting bead outer wall portion in an unstressed, disassembled condition is less than the radius of curvature of the corresponding cavity so that upon assembly of the mounting bead within the cavity the outer wall portion is forced to assume the curvature of the cavity resulting in a highly effective mounting of the bead. The intermediate section includes a plurality of obliquely disposed crossbars joined together in a pantograph arrangement. The intermediate section further includes a corrugated top wall disposed generally flush with the horizontal surfaces of the slab members and a corrugated bottom wall whereby vertical movement of the top surface of the seal is minimized due to the pantograph arrangement of the crossbars as the seal undergoes expansion and contraction.

15 Claims, 7 Drawing Figures

Fig. 1.
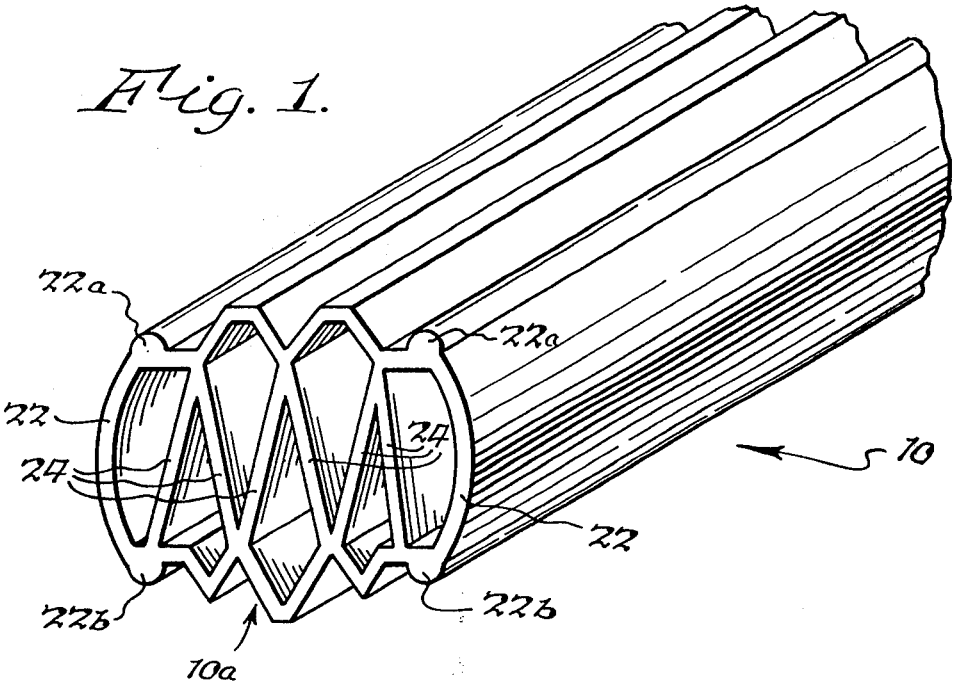
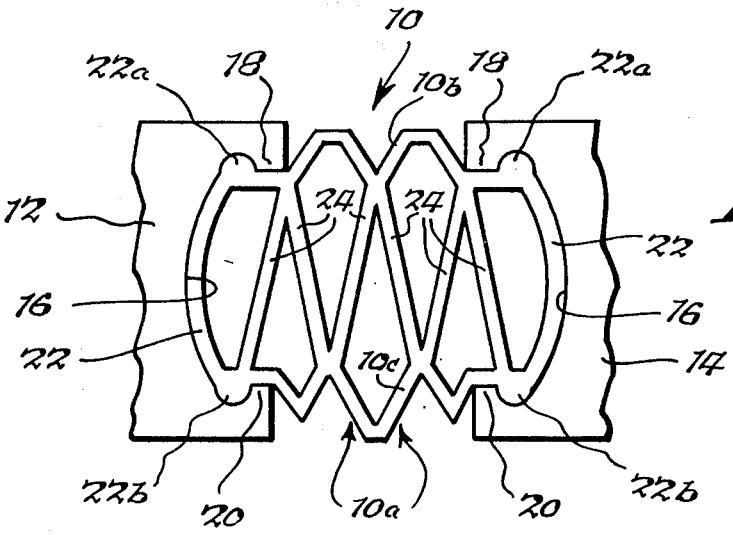
Fig. 2.
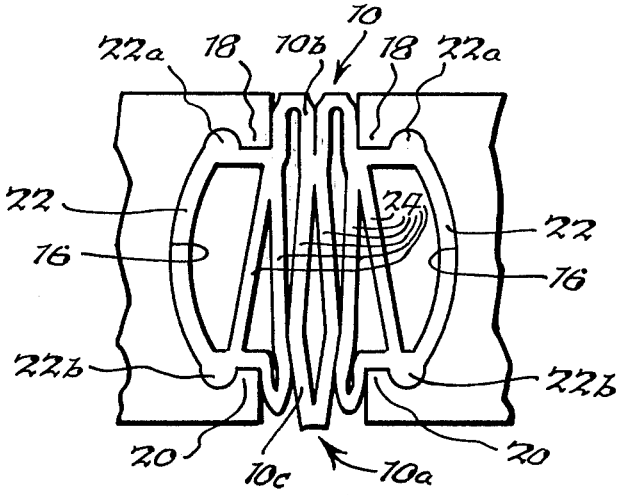
Fig. 3.

CONCOURSE SEAL

BACKGROUND OF THE INVENTION

This invention relates to an expansion joint seal of the type used for sealing an expansion gap against the intrusion of dirt, water and other debris, as for example might be encountered by expansion joints in a pedestrian walkway. More specifically, the present invention relates to an elastomeric expansion seal that may be employed in a joint assembly wherein the seal is connected between a pair of spaced-apart, structural slab members.

One problem encountered with many available expansion joint seals is that the retaining or mounting bead portions become dislodged from one of the slab members or edge element therein over part or all of the longitudinal lengths of the joint with the result that the seal no longer remains watertight and thus, ceases to perform one of the principal functions for which it was provided.

There have been various proposals for the design of seal mounting beads and other approaches to the design of expansion joint seals in general which have had the objective of minimizing the possibility of failure of the joint by dislodging of the seal from the slab members. In regard to expansion seals having mounting beads along the longitudinal edges thereof for mounting in a corresponding cavity of the slab members, a number of specific problems have been encountered. It has been found very difficult in the prior art to form a cavity in a slab member, or edge member element associated with the slab, so that the cavity includes a predetermined cross section with a specified degree of tolerance along the entire length thereof. For example, in extruding a metal edge member with a cavity therein on the order of 16 feet in longitudinal length, it has been found that the extrusion process fails to maintain uniformity in the cross sectional dimensions of the cavity along the entire longitudinal length thereof. On the other hand, it has been found possible in the prior art to maintain a relatively high degree of tolerance with respect to the outer surface cross sectional dimensions of an extruded mounting or retaining bead of an expansion seal. Necessarily, resultant differences in uniformity between the aforesaid seal beads and associated cavities result in the possibility of the bead being more easily dislodged from the edge member. A solution to this problem is disclosed and claimed in U.S. Pat. Nos. 3,994,609 - G. S. Puccio, issued Nov. 30, 1976, 4,018,539 - G. S. Puccio, issued Apr. 19, 1977 and U.S. Ser. No. 702,044 - G. S. Puccio, filed July 2, 1976, now U.S. Pat. No. 4,067,660 all of which are assigned to the assignee of the instant invention.

Another problem encountered in the prior art and overcome by the aforesaid cited references related to the necessity of reducing the size of the mounting bead to permit its insertion into the cavity of an edge member element or slab. A common technique for permitting the reduction in size of the bead was to make it hollow, thereby permitting the bead to be compressed for reception into the retaining cavity of an edge member. Unfortunately, it was found that such prior art hollow beads operated in reverse, and that being subject to compression, they could be easily pulled out of the edge member slab cavity under various conditions, such as water intrusion and freezing.

The present invention incorporates the teachings of the aforesaid references in a seal considered for use primarily in a walkway or concourse situation. Necessarily, the structural slab members forming an outdoor concourse or walkway are subject to expansion and contraction due to environmental conditions as are the slab members forming a road joint, for example. However, in concourse or walkway construction, it is important that the seal not rise above the level of the slab members at any time so as to avoid tripping. In addition, it is desirable that the seal fill the expansion gap between the slabs at a level as close to the top of the slab members as possible so as to avoid, for example, the heels on women's shoes from possibly becoming wedged in the expansion gap.

In addition to the seal filling the gap at a point adjacent to the surfaces of the slab members, it is also desirable that the seal have sufficient strength to withstand vertically applied pressure, such as from women's shoe heels.

SUMMARY OF THE INVENTION

It is an object of the present invention to provide an expansion joint seal fulfilling all of the above requirements.

It is another object of the present invention to provide the foregoing expansion seal with effective mounting beads and an intermediate section connected to the mounting beads having sufficient flexibility to accommodate movements of the slab members while maintaining the desired sealing action at a vertical level adjacent to the upper surfaces of the slab members and while not extending above the same.

It is a further object of the present invention to provide the foregoing seal so as to include a wide range of movement for expansion and contraction.

In summary, the present invention provides a seal for an expansion joint having an intermediate section including intersecting crossbars for spanning the expansion gap and with tubular mounting beads attached along each of the longitudinal edges of the intermediate section. Each of the mounting beads is adapted to be compressed for insertion into a C-shaped cavity of preselected curvature formed in a slab member or edge member element associated therewith as referred to hereinabove. The C-shaped cavity opens towards the expansion gap and includes opposed projecting portions defining an opening therebetween. Each mounting bead of the seal in a disassembled condition includes a vertical dimension nominally equal to the vertical dimension of the edge member cavity. In addition, the bead includes a curved outer wall portion which, in a disassembled condition, has a radius curvature less than the corresponding cavity wall so that upon insertion of the bead within the cavity the upper and lower portions of the bead laterally abut the spaced portions defining the cavity opening and the curved outer surface of the bead is affirmatively forced to assume the curvature of the cavity wall. The intermediate section of the seal includes a plurality of intersecting crossbars formed in a pantograph arrangement whereby vertical movement of the intermediate section is minimized during expansion and contraction of the slab members. In addition, the intersecting crossbars are surmounted by a corrugated top wall to further fill the gap at a point adjacent to the upper surfaces of the slab members. The intermediate section also includes a corrugated bottom surface to provide increased rigidity to the entire intermediate section.

The foregoing and other objects, advantages and characterizing features of the present invention will become clearly apparent from the ensuing detailed description of an illustrative embodiment thereof, taken together with the accompanying drawings wherein like reference characters denote like parts throughout the various views.

BRIEF DESCRIPTION OF THE DRAWINGS

FIG. 1 is a perspective view of the expansion seal forming the present invention shown in fragmentary form to denote an indefinite length;

FIG. 2 is a vertical sectional view of the expansion seal bridging a pair of spaced structural slab members;

FIG. 3 is a view similar to FIG. 2 showing the seal of the present invention in a fully compressed condition;

DETAILED DESCRIPTION OF THE INVENTION

Referring in detail to the illustrative embodiment depicted in the accompanying drawings, there is shown in FIG. 1 an elongated, resiliently yieldable expansion seal, generally designated 10 constructed in accordance with this invention.

Sealing member 10 preferably is composed of a resiliently yieldable elastomeric material, such as neoprene for example, or any other elastic material having similar properties of durability, sufficient compression and expansion capabilities, high abrasion resistance and capable of withstanding temperature extremes, sunlight, weathering, oxidation and deleterious chemicals. Sealing member 10 is formed of a unitary, one-piece construction by a suitable extrusion process and can be of any length desired. While sealing member 10 can take various outside dimensions to conform to the width of the grooves in which it is to be used, the width is generally of a greater dimension than the height thereof. Also, it should be understood that although sealing member 10 is especially adapted for use between adjacent pavement slabs of a walkway construction, it has general utility in various expansion joint applications such as those employed in highways, sidewalks, airfields, building structures and the like.

Figure 4:
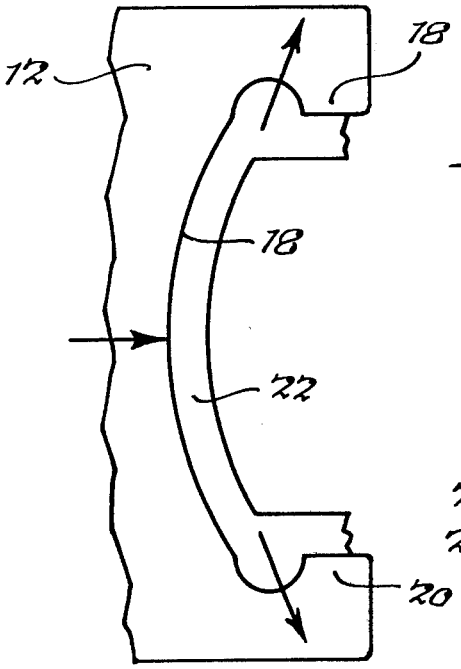
FIG. 4 is a vertical sectional view illustrating the bead portion of the seal fully inserted within a cavity in a slab member.

In FIG. 2, the expansion seal 10 bridges a gap between a pair of structural slab members 12 and 14 as might be found in a walkway or concourse construction. It is to be understood that the slab members could be provided with metallic edge members or the like which would be permanently affixed or embedded in the slab members for mounting of the seal, such construction being well known in the prior art. As shown most clearly in FIGS. 2, 3 and 4, each of the slab members includes a C-shaped cavity 16 having a preselected radius of curvature wherein each of the cavities open towards the gap as defined by the slab members 12 and 14. As further seen in FIGS. 2 through 4, each cavity opening is defined by opposed projecting portions of the slab members indicated at 18 and 20 and which are spaced from each other a distance less than the maximum dimension within the cavity taken generally parallel to the opening between projections 18 and 20. In other words, the cavity opening is less than the vertical height of the cavity as seen in FIGS. 2 through 4.

Expansion seal 10 includes an intermediate section **10*a* spanning the gap between the slab members and mounting bead portion 22 extending along each longitudinal edge of the intermediate section 10*a*. The intermediate section includes a plurality of crossbars 24 arranged in a zigzag manner so as to provide, in combination with the corrugated top and bottom walls 10*b* and 10*c* of the intermediate section, a pantographic formation. The crossbars 24 tend to fold toward one another or expand away from one another during respective compressions and expansions of the gap defined between the slab members 12 and 14**. The movement of the crossbars takes place at the intersections of their end points.

Each of the mounting beads 22 includes in cross section an outer curved surface for matching engagement with the encompassing wall surface of cavity 16 when in an assembled position therewith. The upper and lower opposed portions **22*a* and 22*b* of the beads are provided to correspondingly abut the opposed projecting portions 18 and 20 which define the cavity opening whereby lateral movement of a bead towards the gap is prevented, as is apparent from FIGS. 2 through 5. As will be more fully described hereinbelow, the curved outer wall surface of the bead in an unstressed, disassembled form, is provided with a preselected radius of curvature which is less than the radius of curvature of the corresponding curvature of the wall portion in cavity 16**.

Figure 5:
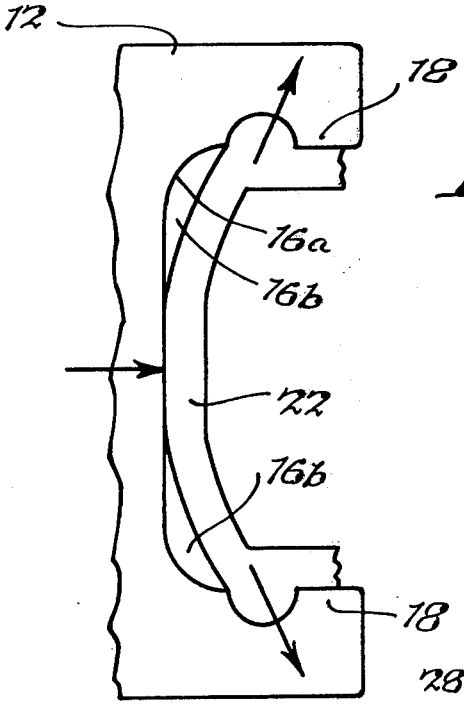
FIG. 5 is a view similar to FIG. 4 showing a cavity with a flat mid-section.

FIG. 5 shows an alternative design for a slab member cavity and is indicated as **16*a*. A relief area 16*b* is provided between the cavity wall and the upper and lower portions of the bead which facilitates assembly of the bead therein. In this regard, relief portions 16*b* could also be provided by appropriate contouring of the outer surface of the bead wall. For purposes of relating the preselected radius of curvature of the outer bead surface in FIG. 5 to the substantially vertical, flat mid-portion of the wall of the cavity 16*a*** in FIG. 5, such flat mid-portion of the cavity wall could be viewed to have a radius of curvature of infinite length to which the corresponding mid-portion of the outer surface of the bead is forced to conform. The force vectors illustrated in FIG. 5 illustrate the lock-in forces developed during assembly of the bead which are substantially equivalent to those force vectors shown in FIG. 4. In this regard, it is to be understood that although the nominal dimension of the mounting bead in a disassembled condition which corresponds to the maximum dimension within the cavity taken parallel to the cavity opening is generally equal thereto, such a tolerance can be difficult to provide in actual practice. Therefore, it is to be understood that the aforesaid maximum dimension of the bead could be slightly less than the corresponding dimension of the cavity and dependable mounting of the bead would still be provided.

Figure 6:
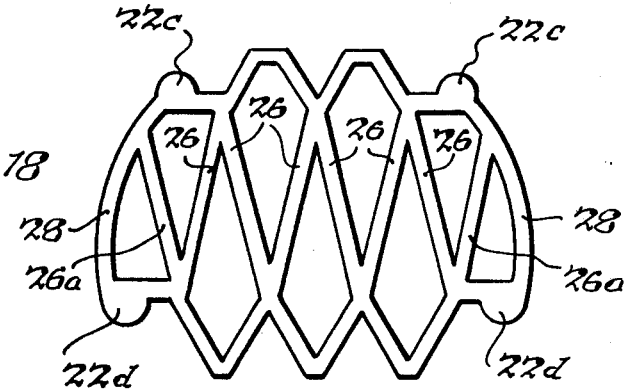
FIG. 6 is an end view of an alternative seal construction embodying the present invention wherein the mounting beads are oriented slightly oblique to a vertical plane and the crossbars of the intermediate section extend into and intersect the inner surfaces of the bead portions.

FIG. 6 illustrates an alternative embodiment to that shown in FIGS. 1 through 3. In FIG. 6, the upper and lower bead projections 22c and 22d are oriented slightly oblique to a vertical plane and the outermost crossbars 26a are formed to intersect with generally the mid-portion of the inner surface of the bead wall 28. The inwardly spaced crossbars 26 in FIG. 6 operate in a similar manner to those crossbars indicated as 24 in FIGS. 1 through 3 when viewed in combination with the corrugated top and bottom wall surface on the intermediate section of the seal. The outermost crossbars 26a in FIG. 6 provide a stiffening effect to the bead since it is supported at its mid-section with the crossbar 26a working to further prevent and insure that the bead wall 28 will not collapse in an inward direction during assembly of the bead. This arrangement further enhances the structural integrity of the locking lugs or projections 22c and 22d with respect to potential pulling out of the same from a slab member cavity.

Figure 7:
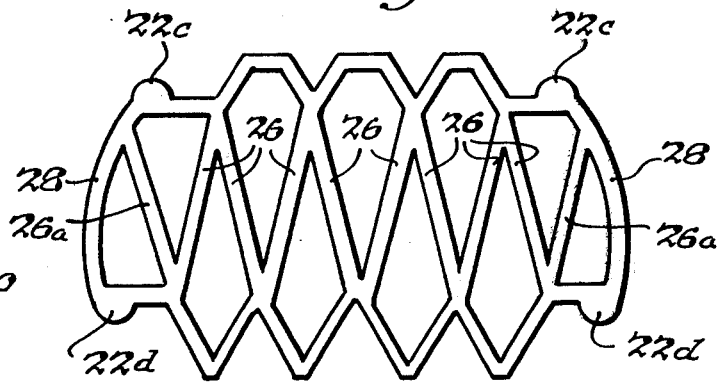
FIG. 7 is a view showing a seal having bead portions the same as those in FIG. 6 but having a web portion connecting the beads which is greater in width than the corresponding portion of FIG. 6.

FIG. 7 is substantially identical to FIG. 6 except that additional crossbars 26 have been provided to extend the width of the seal web portion connecting the beads on the seal one to another. In this regard it is to be understood that the dimensions of the beads and the corresponding cavities therefore with respect to FIGS. 6 and 7 can be maintained identical while altering the width of the seal as desired by selectively specifying additional crossbars 26 and the associated corrugated portions of the top and bottom wall. Accordingly, the width of a seal can be custom designed for any particular application while still utilizing standard edge members and beaded formations.

In describing the operation of the seal, consideration will first be given to the static characteristics of a bead in an assembled position and then consideration will be given to the dynamic characteristics of each bead during expansion and contraction of the structural slab members.

As described hereinabove, the radius of curvature of the outer wall portion of bead 22 prior to assembly is less than the radius of curvature of the corresponding cavity wall portion 16. The bead may be compressed so as to be inserted through the opening defined by the cavity projections 18 and 20. In this manner, the bead portions 22a and 22b become locked behind the cavity projections 18 and 20 respectively to assume the assembled position. However, the locking of the upper and lower portions of the beads against the cavity projections will affirmatively force the outer wall portion of bead 22 to assume the curvature of the adjacent cavity wall. As is apparent, the cavity wall will be in firm engagement with the outer surface of the bead as graphically illustrated by the force vectors in FIGS. 4 and 5. Such a modification of the curvature of the bead outer wall will tend to induce bead portions 22a and 22b to separate from one another. However, when the nominal vertical height of the bead in a disassembled position is generally equal to or preferably slightly less than the vertical height of cavity 16, the bead becomes only more firmly locked within the cavity as the upper and lower portions thereof are forced into a tight engagement with the adjacent portions of the cavity as the curvature of the wall portion of the bead is modified by its engagement with the adjacent cavity wall.

As shown by the force vectors in FIG. 4, the curved wall portion of bead 22 will necessarily experience a reaction force so as to firmly engage the cavity wall. It therefore can be understood that the insertion of a bead 22 within cavity 16 develops an internal locking pressure within the bead by the modification of the curvature of the outer wall surface of the bead and that any variations in the cross-sectional configuration of the cavity will be compensated for by such internal locking pressure developed within the bead whereby the latter tends to positively engage the surrounding cavity wall.

In addition, the pantograph arrangement formed by the crossbars and the corrugated top and bottom walls in the intermediate section function to expand and contract in an accordian-like manner. The crossbars pivot at their end points and being only slightly oblique with respect to a vertical plane, do not substantially alter the vertical level of the upper surface of the seal with respect to the horizontal surfaces of the slab members. As seen in FIG. 2, the seal is in a relatively expanded condition with the intermediate section thereof slightly below the upper surfaces of the slabs 12 and 14. In FIG. 3, the seal is greatly compressed and the upper surface of the intermediate section of the seal is generally in a plane parallel to the surfaces of the slab members 12 and 14.

From the foregoing, it is apparent that the objects of the present invention have been fully accomplished. As a result of this invention, an improved elastomeric seal has been provided to have mounting beads which are firmly locked in associated cavities of slab members. Static locking of the beads is primarily made more effective by the change in curvature of the bead wall portions by their engagement with the cavity walls. In addition, the upper surface of the intermediate section of the seal undergoes very minimal vertical growth during compression of the seal due to the pantograph arrangement of its crossbars, top and bottom walls. Such construction enables the seal to be effectively used in concourse or walkway applications.

Having thus described and illustrated preferred embodiments of the invention, it will be understood that such description and illustration is by way of example only and such modifications and changes as may suggest themselves to those skilled in the art are intended to fall within the scope of the present invention as limited only by the appended claims.

I claim:

1. An expansion joint assembly having a pair of spaced-apart structural slab members defining a gap therebetween and a seal connected between said slab members for bridging said gap, each said slab member having in cross-section a generally C-shaped cavity with a preselected radius of curvature, each said cavity opening toward said gap defined between said slab members wherein each said cavity is defined between opposed projecting portions of said respective slab members spaced from each other a distance less than the maximum dimension within said cavity taken generally parallel to said opening, and said seal comprising an elongated body including a mounting bead portion extending along each of its longitudinal edges with an intermediate section interposed between and formed integral with said mounting bead portions for spanning said gap wherein each of said mounting bead portions is received within said cavity of a respective slab member, each mounting bead having in cross-section an outer surface portion for matching engagement with said cavity with opposed portions of said mounting bead correspondingly abutting said opposed projecting portions of said slab member and tending to move away from one another within said cavity whereby relative lateral movement of said mounting bead with respect to said slab member is resisted, and the radius of curvature of said outer surface of said mounting bead in an unstressed, disassembled form being less than said preselected radius of curvature of said cavity so that upon assembly of said mounting bead within said edge member cavity said outer surface of said mounting bead is affirmatively urged to assume the greater radius of curvature of said cavity by the abutment of said opposed portions of said mounting bead with said opposed projecting portions of said slab member resulting in said movement of said opposed portions of said mounting bead away from one another, and said intermediate section comprising a plurality of crossbars intersecting at the opposite ends thereof and collapsing upon movement of said mounting beads towards one another during compression of said seal.

2. An expansion joint assembly as set forth in claim 1 wherein said intermediate section crossbars are formed in a pantograph arrangement.

3. An expansion joint assembly as set forth in claim 2 wherein said intersecting crossbars of said intermediate section extend into and engage said mounting beads.

4. An expansion joint assembly as set forth in claim 3 wherein the mid-section of the inner surface of each said mounting bead is intersected by said crossbars so as to further prevent movement of said outer surface of said mounting bead away from said respective slab cavity.

5. An expansion joint assembly as set forth in claim 1 wherein said intermediate section comprises a corrugated top wall and a corrugated bottom wall joined at the respective opposite ends thereof to said mounting bead portions.

6. An expansion joint assembly as set forth in claim 5 wherein said intersecting crossbars of said intermediate section extend from said corrugated top wall downwardly to said corrugated bottom wall, adjacent pairs of said crossbars being interconnected at correspondingly adjacent ends, and the outermost of said crossbars being connected adjacent their ends to said mounting bead portions to form a collapsible pantograph arrangement.

7. An expansion joint assembly as set forth in claim 1 wherein the nominal dimension of said mounting bead, in a disassembled condition, which corresponds to said maximum dimension within said cavity taken generally parallel to said opening is generally equal thereto so that upon assembly of said mounting bead within said cavity said mounting bead develops a locking pressure therein.

8. An expansion joint assembly as set forth in claim 7 wherein said intermediate section crossbars are formed in a pantograph arrangement.

9. An expansion joint assembly as set forth in claim 7 wherein said intermediate section comprises a corrugated top wall and a corrugated bottom wall joined at the respective opposite ends thereof to said mounting bead portions.

10. An expansion joint assembly as set forth in claim 9 wherein said intersecting crossbars of said intermediate section extend from said corrugated top wall downwardly to said corrugated bottom wall, adjacent pairs of said crossbars being interconnected at correspondingly adjacent ends, and the outermost of said crossbars being connected adjacent their ends to said mounting bead portions to form a collapsible pantograph arrangement.

11. An expansion joint assembly as set forth in claim 1 wherein the nominal dimension of said mounting bead, in a disassembled condition, which corresponds to said maximum dimension within said cavity taken generally parallel to said opening is slightly less than said maximum dimension so that upon assembly of said mounting bead within said cavity, said mounting bead still develops a locking pressure therein.

12. An expansion joint assembly as set forth in claim 1 wherein said preselected radius of curvature of each said cavity in said slab members is of infinite length.

13. An expansion joint assembly as set forth in claim 1 wherein relief portions are provided in the outer surface of each said mounting bead on opposite sides of the mid-portion of said upper surface so as to facilitate engagement of said mounting means within said respective cavities.

14. An expansion joint assembly as set forth in claim 1 wherein said intersecting crossbars of said intermediate section extend into and engage said mounting beads.

15. An expansion joint assembly as set forth in claim 14 wherein the mid-section of the inner surface of each said mounting bead is intersected by said crossbars so as to further prevent movement of said outer surface of said mounting bead away from said respective slab cavity.

* * * * *